US005387442A

United States Patent [19]

Kroeger et al.

[11] Patent Number: 5,387,442

[45] Date of Patent: Feb. 7, 1995

[54] METHOD OF COATING HEAT SENSITIVE MATERIALS WITH POWDER PAINT

[75] Inventors: Rolf Kroeger, Luvinate, Italy; Konrad Ortlieb, Stuttgart, Germany; Sergio Gazzea, Romano D'Ezzelino, Italy

[73] Assi~nee: Hoechst Italia S.p.A., Milan, Italy

[21] Appl. No.: 961,906

[22] PCT Filed: Jul. 12, 1991

[86] PCT No.: PCT/EP91/01322

§ 371 Date: Jan. 15, 1993

§ 102(e) Date: Jan. 15, 1993

[87] PCT Pub. No.: WO92/01517

PCT Pub. Date: Feb. 6, 1992

[30] Foreign Application Priority Data

Jul. 18, 1990 [IT] Italy ..... 20970A/90

[51] Int. Cl.[6] ..... B05D 3/06

[52] U.S. Cl. ..... 427/521; 427/195; 427/374.3; 427/374.4; 427/375; 427/379; 427/385.5; 427/398.1; 427/559

[58] Field of Search ..... 427/492, 559, 521, 195, 427/202, 474.3, 474.4, 375, 379, 385.5, 398.1

[56] References Cited

U.S. PATENT DOCUMENTS 4,665,626 5/1987 Berkmann et al. ..... 34/1

FOREIGN PATENT DOCUMENTS 330237 8/1989 European Pat. Off. .
2638663 11/1933 France .
3809654 11/1989 Germany .
59-87135 5/1984 Japan .
8503766 8/1985 WIPO .

OTHER PUBLICATIONS

Patent Abstracts of Japan, vol. 8, No. 197 (M-324) (1634), Sep. 11, 1984.

*Primary Examiner*—Bernard Pianalto
*Attorney, Agent, or Firm*—Grimes & Battersby

[57] ABSTRACT

A method of coating heat sensitive materials with powder paint is described, which is based on repetitive heating cycles of paint coating by radiation example infrared, interspersed with cooling cycles, which there is a temperature difference between the paint coating and substrate such as to allow the filmation and subsequent curing of the paint without damaging the substrate.

6 Claims, 2 Drawing Sheets

METHOD OF COATING HEAT SENSITIVE MATERIALS WITH POWDER PAINT

The present invention refers to a method by which it is possible to coat heat sensitive materials with powder paints. In the context of this report the term "heat sensitive materials" means materials which undergo physical and/or chemical modifications when treated at temperatures and times currently used in timing processes and possibly curing of paints in powder form, while "heat resistant materials" are those which do not undergo these modifications.

Powder paints are assuming an always greater importance for coating metallic or heat resistant objects of any type, given that these have eliminated numerous problems of environmental pollution and danger to the health of workers employed in painting, other than forming coatings with excellent qualities.

Powder paints, after having been applied to the objects by means off various systems, and today principally electrostatically, they must however be subject to melting, filmation and possibly curing to adhere permanently to the objects, and this generally takes place in kilns of various structure according to the objects to be coated, and always at rather high temperatures, made necessary by the melting temperatures of the paint components and maintaining these temperatures for continuous set times.

However until today it has been considered impossible to coat heat sensitive materials with powder paints, such as plastic materials, wood, paper and cardboard, leathers, textiles and so on, because these materials absolutely cannot resist the temperatures necessary for powder paint treatment for a continuous time. On the other hand it would be highly desirable to be able to coat these materials with powder paints too, to eliminate the abovementioned dangers and risks also in these industrial sectors due to the use made, currently necessary, of solvent-containing paints to coat the above mentioned heat sensitive materials.

The structures and methods carried out until now for the treatment of objects coated with powder paints do not however allow the treatment to be extended to heat sensitive materials which would be irremediably damaged. All the existing structures and methods are only suitable for metallic or heat resistent objects. In particular treatments by means of inffrared radiation exist, but the temperatures and times of the treatment are prohibitive for heat sensitive materials. From German patent DE-34 06 789 C1 (Berkmann) a process is known for filming and curing objects coated with powder paints by infrared radiation, in which an intermediate neutral area is provided between two heating areas which allows a certain cooling of the objects during treatment, but also here the treatment temperatures and times in the areas are such as to exclude any utilization for heat sensitive materials.

In particular according to the details of the description of the above mentioned patent the temperature of the object is lowered only slightly, so that one can compensate for the temperature differences between thicknesses of different entity in the object. As a whole however, also in this case the temperature of the object remains excessive. Furthermore, Ebb whole object is heated by means of air circulation, something to be avoided in the presence of heat sensitive materials.

In the Japanese application A 59-87135 (Inoue et al.) a process is described for coating the surface of a polyurethane foam molded product with a thermoplastic synthetic resin, which is heated to be melted and then caused to solidify. No evidence is given of using thermosetting powders, nor means are specified to overcome problems of melting, spreading and curing such materials.

EP-A-O 330 237 (Hörmann KG) discloses a process for coating hollow metal panels filled with heat-sensitive plastic material. In this case the substrate is heated only by conduction through a metal wall, which provides protection to some extent. The performance of this process may be objectionable when no shield is present and either heat is transmitted through the thin paint coating to the substrate, or even reaches it directly by irradiation after the paint is melted, in particular if a clear coating is to be used.

In W. Bruegel, Physik und Technik der Ultrarotstrahlung, Chapter F. Lackhaertung (pages 383–395), Curt Vincentz Verlag, Hannover 1961, it is proposed (page 394) to subject paints on wood to a "shock hardening", applying a strong irradiation for a brief period, without first heating the (wooden) base. However it is not explained how such a treatment is to be carried out. With solvent based paints, as opposed to that which occurs with powder paints, one is unlikely to have spreading problems.

In "Pulver & Lack", No. 2, 1979, page 110 and following, in particular page 112, the subdivision is proposed of the hardening of the powder paints in a "spreading phase", and a true and proper "curing phase". First, however, a low temperature is maintained and then the hardening temperature is immediately increased, which in practice does not produce a good spreading and exposes the material to high temperatures for a rather long period.

The present invention for the first time resolves this influential problem and finally allows the coating of heat sensitive materials with powder paint, overcoming the prevention threshold imposed by the powder paint treatment temperature, which until now seemed absolutely impassable.

The procedure according to the present invention consists essentially of treating the substrate (that is the object) and the paint applied to it at short alternate intervals, with short operation times at high temperature by means of radiation, such as for example medium or short waves in the infrared range and with cooling times or passive zones of treatment interruption interspersed between subsequent operation times, the various parameters of the procedure being variable and adjustable in an optimum way as a function of the materials in play, in order that a perfect layer of paint is obtained, without damaging and/or worsening the properties of the painted material.

In this way the heat necessary for the melting, filmation and curing if any, of the paint layer does not have time to attack the heat sensitive material of the substrate in a damaging way, in as much as the heat is dissipated during the cooling intervals. It is however important that the heating speed is high, which is obtained with a high irradiation power.

Preferably the paint layer is heated rapidly to a temperature at which thermal damaging does not yet take place, then it is cooled to a suitable temperature for the curing of the paint and this temperature is maintained until the curing is completed.

The first heating cycle is preferably interrupted as soon as the spreading of the paint has finished.

The cooling is preferably carried out each time at temperatures lower than 100° C.

IR irradiation powers of at least 40 $kW/m^2$ are used. The parameters of the process, such as the heating time, the maximum temperature allowed, cooling and so on, each time must be adapted to the substrate and the powder paint and determined by means of preliminary tests.

This physical action of alternation of short treatment and cooling periods can be assisted by combining it with the incorporation of additives in the powder paint composition, which in a certain way could function as a buffer zone with respect to the heat's action.

One could also foresee the application of an intermediate protective layer of materials suitable for protecting the substrate from the heat and which is at the same time compatible both with the substrate and the paint, in order to guarantee and preserve the perfect adhesion of the paint layer to the substrate.

Moreover by means of the use of suitable additives, one could also think, for example in the case of synthetic thermoplastic or thermoset materials, of producing composite materials for the substrate, which could increase the instantaneous heat resistance.

These additive substances could be both organic or inorganic and could for example include known thermoinsulating compounds such oxides, silicon oxides, silicon oxides, titanium fibres and so on.

To carry out the method according to the present invention one could construct apparatus in various manners and forms, provided that they fulfil the objective of obtaining alternation of irradiation and cooling times of the object to be treated. It is expecially important that the heating is rapid, which is obtained with high irradiation power.

Thus for example an apparatus could provide an alternation of the treatment and irradiation areas obtained by positioning the objects on a mobile support such as a conveyor belt, which passes under a series of narrow slits at intervals, from which the infrared radiation is directed on the objects, which thus pass in rapid succession through active treatment areas and passive cooling areas. In this way continuous cycle treatment of the objects would be obtained. It is important only that the irradiation power is sufficiently high; the heating time will then be determined simply by the length of the action range of the lamp and by the velocity of the conveyor. The cooling occurs in an area free from the lamp and if necessary can be assisted for example by cold air.

Another form of apparatus could however provide a chamber in which the sources of infrared radiation are placed behind mobile screens which alternatively cover and uncover the sources, in such a way that the objects are treated when the sources are uncovered, and cooled when the sources are covered by the screens which could for example assume the form of rotating and oscillating slats in the manner of blinds or louvers.

Other systems could provide the switching on or switching off of the irradiation sources at brief intervals, for example by means of a phase delay command, while the power could be regulated for example by a thyristor.

The objects, characteristics and advantages of the method are still clearer and more evident from the following detailed description of some specific examplary embodiments, in which some practical values of some parameters which must be taken into consideration in the carrying out of the method are supplied.

Experiments of application of the method have been carried out on various substrates such as synthetic materials, wood and leather, after having chosen powder paints most suitable for such a treatment.

As far as infrared radiation is concerned, it has been found that the best results are obtained with short length infrared radiation in the range between about 0.76 and 2.0 μm, which permit more rapid heating and subsequent cooling of treated materials, as well as maximum speed of regulation of the heat sources, for which one can easily perform temperature and time cycles according to the requirements dictated by various types of substrates and powder paints.

In the experiments an apparatus comprising various infrared radiators was used, each independently adjustable by an electronic circuit of control and phase delay regulation of the sinusoidal input tension and by measuring the temperature produced with a radiation pyrometer as regards the surface temperature of the paint and with thermoelements positioned at various depths within substrate to measure the changes of the temperature as a function of its thickness.

By means of preliminary tests on the slabs of sheet-steel used as a reference it was determined that the optimum spreading of a powder paint is obtained if it is heated very rapidly to the maximum temperature at which there is no thermal damage of the paint coating, and naturally also of the substrate, then it is cooled immediately and subsequently the paint coating hardens or cures.

Maintenance of the maximum temperature is not recommended, in that it does not bring further improvements to the spreading, while damage to the painted surface begins.

However the following are essential for the spreading of the paint the granulometric composition, the viscosity in the melted stage as well as the heating speed which as mentioned is optimum when the infra-red radiation is in the range of 0.76 to 2.0 μm and especially around 1.2 μm.

Thus there is the experimental confirmation that if one attempts to make a film of the powder paint on substrates of heat sensitive materials with only one heating cycle, damage to the substrate and defects in the paint coating layer inevitably occur, while the temperature difference between the superficial paint coating and the substrate is too small for the said substrate to be protected from the effects of the temperature necessary for the powder paint treatment.

In contrast to this, one also has confirmation of the feasibility and excellent results which can be obtained with the method of the present invention. In fact subjecting the materials to two or more shorter heating cycles with intermediate cooling, one obtains strong temperature differences between the surface of the paint coating and the substrate, which can thus stand the thermal treatment much better.

As regards some types of wood, some problems exist due to the emission of water or resin from the pores of the wood especially in the case of young timber and soft pulp, but the procedure is however feasible particularly by subjecting the material to various brief treatment cycles.

For the moment experiments on the SMC (Sheet-Moulding Compound) have been concentrated on, carried out by means of moulding of unsaturated polyester resins and layers of fibreglass and utilised particularly to produce component parts of vehicle bodies, using a thermosetting paint with a base of epoxy-polyester resin.

The experiments were carried out with SMC plates of 4 mm in which holes of various depth were made, starting from the lower side of the sheet, that is to say the opposite side to that on which the powder paint coating is applied. In these holes Ni-CrNi thermoelements are affixed. By means of this adhesion one can determine exactly the measuring point of the material and furthermore there is a good heat transfer between the sheet material and the point of temperature measurement.

BRIEF DESCRIPTION OF THE DRAWINGS

The figures of the appended drawings show the most important characteristics of the experiment, and specifically.

The preparation thus carried out on the SMC sheets therefore allows the recordal of the upper surface temperature with the SP radiation pyrometer, in the SMC sheet at a depth of 0.1 mm (under the upper surface) with the termoelement TE1, at 1 mm with TE2, at 2 mm with TE3, at 3 mm with TE4 and at the lower surface of the sheet (4 mm) with TE5.

The SP pyrometer and the thermoelements TE are calibrated and can be recorded directly. The measuring error is ±1.5° C.

All the experiments are carried out with the paint coatings just applied, thus the absorption relationships are equal and the influences of the endothermic or exothermic cycles are constant.

The repetitive treatment cycle is carried out as follows: heating up to 240° C. (of the paint coating layer) within 3 minutes, maintaining the temperature at 240° C. for one minute, cooling for 10 minutes at 65° C., heating to 240° C., maintainence at 240° C. for 1 minute, cooling.

The irradiation power is of 50 kW/m and the distance between the radiator and the sheet is 120 mm.

Figure 1:
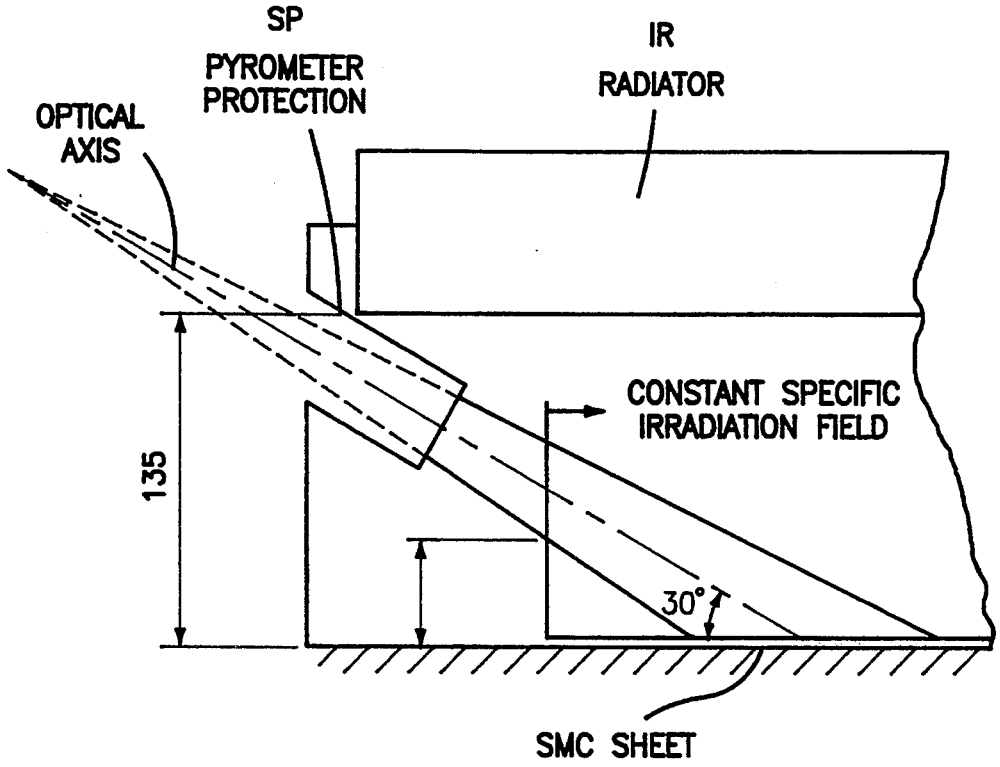
FIG. 1 shows schematically the position of the IR radiator or the SP radiation pyrometer with respect to the SMC sheet.
Figure 2:
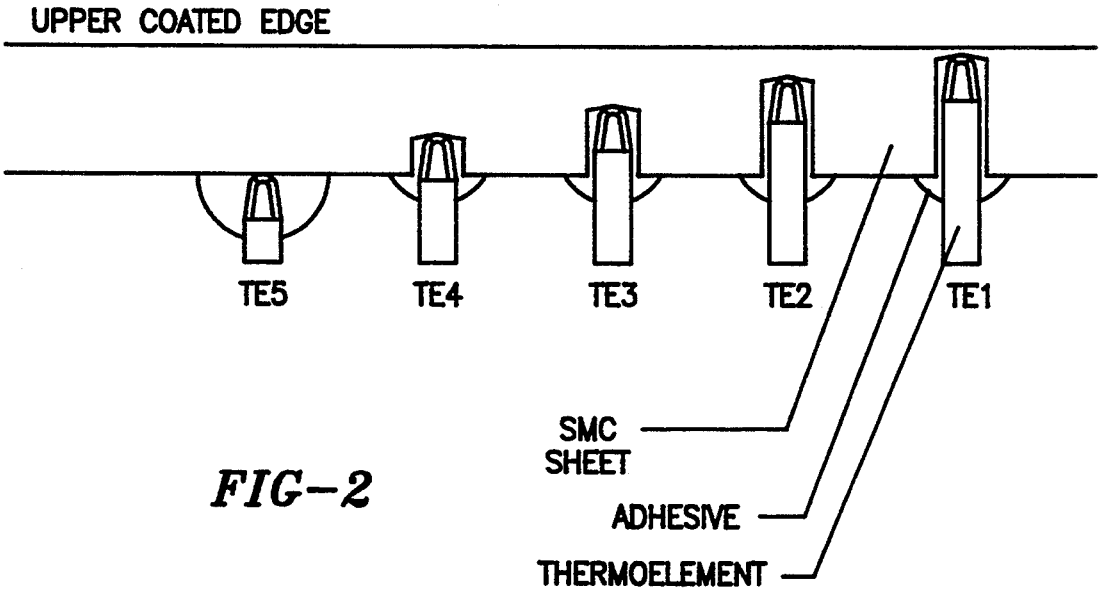
FIG. 2 shows schematically the position of the five thermoelements TE1, TE2, TE3, TE4 and TE5 on the SMC sheet.
Figure 3:
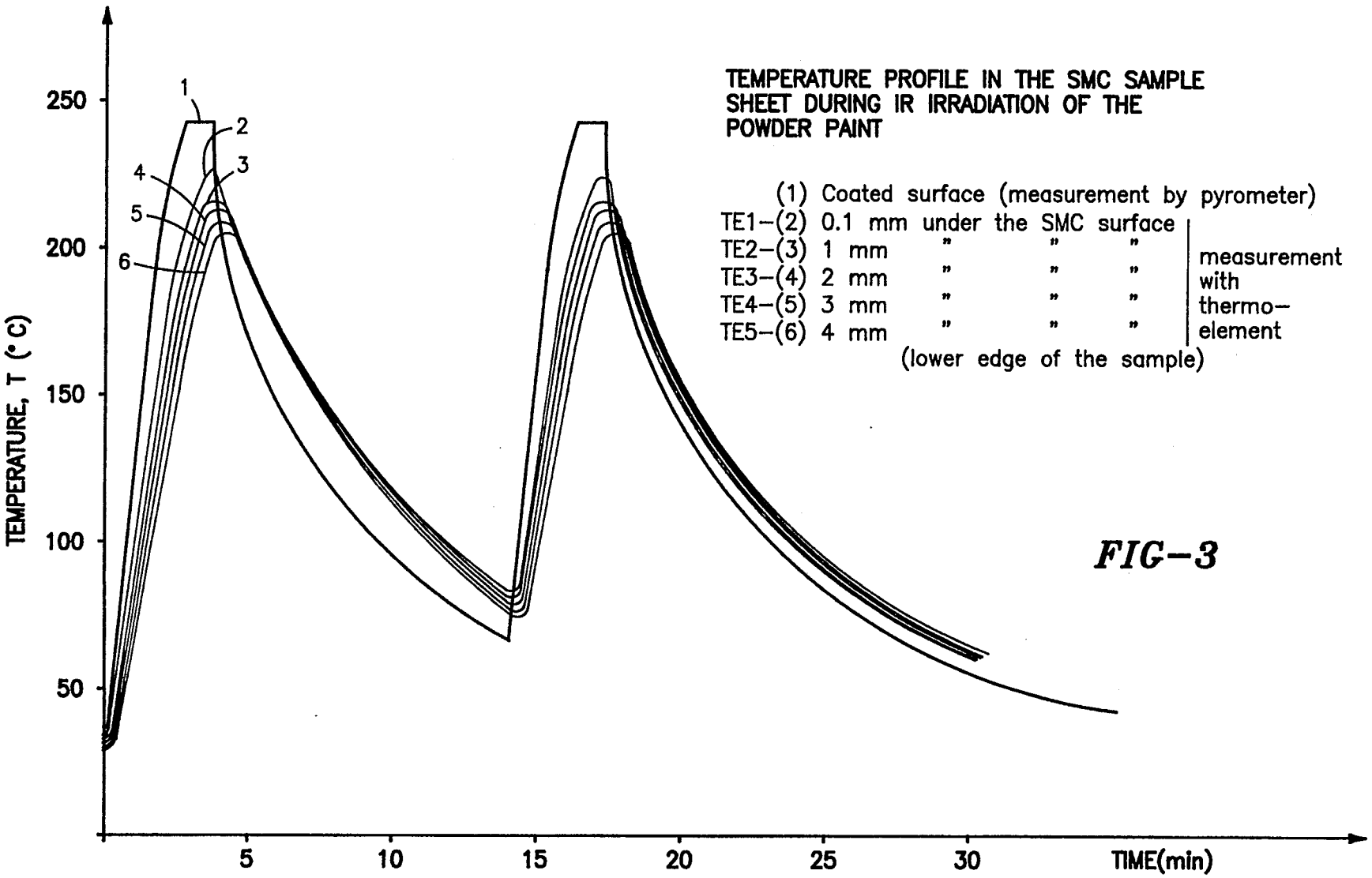
FIG. 3 is a graph showing the profile of the temperature in the SMC sheet during powder paint treatment with infrared radiation according to the method of the present invention.

As the graph of FIG. 3 shows clearly, when a temperature 240° C. is reached, the temperatures of the thermoelements register the following values: TE1=200° C., TE2=192° C.; TE3=185° C.; TE4=180° C.; TE5=176° C.

It can therefore be seen that the temperature at the inside of the sheet is always lower than that of the paint layer, that the maximum temperature difference (40° C.) occurs right in the delimiting layer between the paint coating and the sheet, while the difference between the upper and lower edges of the sheet is about 20° C., and furthermore that in the second heating cycle, even if the cooling does not reach room temperature, the temperature does not exceed that recorded during the first cycle. One can thus verify that by knowing the heat resistance of the substrate material, one can choose the maximum treatment temperature and the number of heating cycles necessary or possible. The period of maintaining the maximum temperature is the deciding factor for the feasiblity of the process and generally must not exceed 1 minute. It is in fact established that with 2 minutes of irradiation no heat sensitive material manages to pass the test intact and detachment of the paint coating, emission of gas and other defects take place. Moreover one must obviously choose a type of powder paint compatible with the substrate in order to avoid bubble formation, dullness and other defects.

By subdividing the treatment into more than two cycles, each of a shorter duration, one can reach a temperature difference between the paint coating (SP) and the delimiting layer of the substrate (TE1) also notably greater with a noteworthy increase the possibilities of the process's use for other materials also.

Thus Further experiments were carried out to find a treatment cycle as advantageous as possible for obtaining an optimum result.

The powder paint layer is first heated with a high irradiation power as rapidly as possible and at a high temperature, maintaining this temperature for a very short time to reduce the thermal load. In this first so-called "physical" stage the paint layer must not cure, but only melt and thus in a brief time reach a very low dynamic velocity which causes a better spreading of the paint film with respect to the conventional slow heating process up to the curing temperature. Only in the subsequent so-called "chemical" stage, carried out at an appreciably lower temperature, does the complete curing of the powder paint film occur, wherein this temperature corresponds at least to that of curing off the paint.

The tests are carried out with a powder paint with very rapid hardening, on degreased sheet steel, with a paint layer thickness of 60 ±10 μm of hardened film and a heating to the temperature TA as rapid as possible.

These parameters are deduced from the table hereinbelow.

| Variants | Duration period | Temperature |
|---|---|---|
| $a_1$–$a_3$ | $t_1$ = 1 sec | $T_A$ = 220, 240, 260° C. |
| | $t_2$ = 10 min | $T_S$ = 180° C. |
| $a_4$–$a_5$ | $t_1$ = 30 sec | $T_A$ = 240, 260° C. |
| | $t_2$ = 10 min | $T_S$ = 180° C. |
| $a_6$–$a_7$ | $t_1$ = 60 sec | $T_A$ = 240, 260° C. |
| | $t_2$ = 10 min | $T_S$ = 180° C. |
| $b_1$ | $t_1$ missing | $T_A$ missing |
| Reference sample | $t_2$ = 15 min | $T_S$ = 180° C. |

The measurements carried out on the samples are as follows:

thickness of the layer (magnetoinductive method—Standard DIN 50981)

ball falling test (Ericksen 304 type—height of fall 50 cm no damage)

resistence to acetone (no dissolving of the hardened paint layer)

brilliance (60—reflectometer value according to Standards DIN 67530, ASTM D 523)

spreading according to arbitrary scale (points from 1=specular to 4=lacking)

chromatic deviation $E_{AN}$ (according to Standard DIN 6174) and the results are reported in the following table,

| Test | $T_A/t_1 \cdot T_S/t_2$ profile (°C./sec · °C./min) | Thickness of layer (μm) | Ball fall | Acetone resistance | Brillance (60°) | Chromatic Shift (ΔE) | Spreading |
|---|---|---|---|---|---|---|---|
| Radiator - sample distance 120 mm; power absorption of IR radiator 3 × 1 kW | | | | | | | |
| $a_1$ | 220/1 · 180/10 | 58–75 | good | yes | 87 | 0,69 | 2,5 |
| $a_2$ | 240/1 · 180/10 | 59–70 | good | yes | 86 | 2,0 | 2,5 |
| $a_3$ | 260/1 · 180/10 | 52–61 | good | yes | 83 | 2,34 | 3 |
| $a_4$ | 240/30 · 180/10 | 55–76 | good | yes | 85 | 2,24 | 2,3 |
| $a_5$ | 280/30 · 180/10 | 50–55 | good | yes | 84 | 4,34 | 1,9 |
| $a_6$ | 240/60 · 180/10 | 45–50 | good | yes | 83 | 2,14 | 2 |
| $a_7$ | 260/60 · 180/10 | 53–75 | good | yes | 81 | 4,05 | 1,5 |
| $b_1$ | 180/15 | 50–73 | good | yes | 88 | 0,05 reference $BaSO_4$ | 4 |

From the results of the table it is clear that by means of the subdivision of the process into a preliminary "physical" and a subsequent "chemical" stage one obtains a noteably better spreading of the paint film than with conventional methods.

Thanks to the brief duration of the "physical" stage the thermal load of the paint layer and therefore the danger of chromatic alteration are notably reduced.

One can provide a further improvement to the spreading of the paint and a further decrease in the chromatic alteration again by optimising the parameters of the method, and in particular the heating velocity, the value of the maximum temperature $T_A$, the duration period at $T_{AX}$, the velocity $T_S$ and the value of temperature $T_S$. Here also one can subdivide the "chemical" phase in several intervals of limited duration to obtain better results and avoid any thermal damage due to a too long exposure to temperature $T_S$.

We claim:

1. Method of coating a heat sensitive substrate with a thermosetting powder paint, said method consisting of:
   applying a coating of a said thermosetting powder paint to said substrate;
   heating said paint coating and substrate to cause melting, filmation and curing of the paint coating using infrared radiation having a wavelength of between about 0.76 and about 2.0 μm and having an irradiation power of at least about 40 kW/m$^2$;
   maintaining the application of said infrared radiation for a period of time less than about one minute;
   cooling said paint coating and substrate;
   re-heating said paint coating and substrate; and
   re-cooling said paint coating and substrate.

2. Method according to claim 1, characterized in that the heating temperature of cycles subsequent to the first one is equal or less than that of the first cycle, but of a value which allows the continuation of the filmation and curing, if any, of the paint.

3. Method according to claim 1 characterized in that the layer of paint is heated rapidly to a temperature at which thermal damage still does not occur; in that then it is cooled to a temperature suitable for the curing of the paint and the fact that this temperature is maintained until the curing is finished.

4. The method of claim 1, wherein the wavelength of said infrared radiation is preferably around 1.2 μm.

5. The method of claim 1, wherein the infrared radiation is removed when the paint coating begins to melt and spread.

6. The method of claim 1, wherein the cooling of the paint and substrate is accomplished at a temperature less than about 100° C.

* * * * *